United States Patent [19]

Corsette

[11] 4,357,718

[45] Nov. 9, 1982

[54] LIQUID DISPENSER

[76] Inventor: Douglas F. Corsette, 6559 Firebrand St., Los Angeles, Calif. 90045

[21] Appl. No.: 162,880

[22] Filed: Jun. 25, 1980

[51] Int. Cl.[3] ..... E03D 9/02

[52] U.S. Cl. ..... 4/228; 4/227; 4/222; 222/56; 222/57; 222/453; 422/266

[58] Field of Search ..... 4/222, 227, 228; 222/56, 57, 319, 453, 519, 562; 422/264, 266, 277

[56] References Cited

U.S. PATENT DOCUMENTS

| | | | |
|---|---|---|---|
| 2,913,734 | 11/1959 | O'Hare | 4/227 |
| 3,341,074 | 9/1967 | Pannutti | 222/57 |
| 3,698,021 | 10/1972 | Mack | 4/227 |
| 3,766,570 | 10/1973 | Finneran | 4/222 |
| 3,778,850 | 12/1973 | Bryan | 4/228 X |
| 3,831,205 | 8/1974 | Foley | 4/228 |
| 3,874,007 | 4/1975 | Dolan | 4/228 |
| 3,908,209 | 9/1975 | Fillmore | 4/227 |
| 4,036,407 | 7/1977 | Slone | 222/453 X |
| 4,244,062 | 1/1981 | Corsette | 422/266 X |

*Primary Examiner*—Henry K. Artis
*Attorney, Agent, or Firm*—Watson, Cole, Grindle & Watson

[57] ABSTRACT

A liquid dispenser, adapted to rest upon the bottom of a flush tank, includes a container having a quantity of the concentrated soluble material therein, and a closure forming a piston extending into the top opening of the container. The closure forms a liquid flow passage between the interior and exterior of the container and is adapted for shifting in response to the flush/fill modes of the tank cycle. The closure rises to its upper limit by flotation from entrapped air within the closure, retains liquid in an open cavity thereof and becomes fully submerged by the rising level of the tank liquid. As the closure rises, tank liquid enters the container through the flow passage for mixing with the chemical concentrate. During the flush mode of the tank, the closure falls by gravity and is augmented by the retained water in its cavity as the receding level of the tank liquid passes below the upper rim of the closure. As the closure falls it effects a positively controlled piston-displacement discharge of liquid chemical concentrate from the interior of the container into the outflowing tank liquid only at the end of the flush cycle. The piston is formed by a bottom wall of an inner depending wall of the closure, or by an air cushion defined by such inner wall, so as to effect a piston-displacement discharge of the chemical concentrate from the interior to the exterior of the container at the end of the flush cycle. The length of the displacement stroke may be varied to adjust the concentration of the treatment by varying the amount dispensed during each cycle. And, an upper reservoir may be formed on the closure in communication through discharge ports with the flow passage for purging the passage of liquid concentrate during the flush cycle.

9 Claims, 13 Drawing Figures

53
25a
58
56
55
25
27
54
60
12
B
57
15
37
26
38
21
13
17
16
29
49
44
48
45
18a
18
51
29a
47
52
46
43

LIQUID DISPENSER

BACKGROUND OF THE INVENTION

This invention relates generally to a liquid dispenser, and more particularly to a device for discharging a chemical concentrate from the interior of a container into the flush tank of a toilet only at the end of the tank flush cycle.

Prior art chemical dispensers for flush tanks are known for dispensing a cleaning fluid into the flush tank of a toilet by employing a positive pumping or piston action. Such dispensers have different modes of operation and often require the chemical container to be inverted in the tank so that the container neck, or a member affixed thereto, functions as a stationary piston coacting with a dispensing member or float. Dispensing may occur near the end of the flush cycle, or may be responsive to rising water levels in the tank. Some of the inverted container-type dispensers employ no positive pumping action, and most of such devices are relatively complex in their arrangement and operation and are somewhat deficient in that they inaccurately meter the chemical into the flush tank.

A flush tank dispenser having its container positioned upright in the tank and employing a positive pumping action for dispensing the product is disclosed in U.S. Pat. No. 3,341,074 to Pannutti. However, the length of the stroke required during the displacement action allows for undue migration of the chemical into the flush tank thereby resulting in an overtreating of the tank water and a needless waste of the chemical. Besides, more tank water than necessary is permitted to enter the container during the tank refill mode before the chemical is sealed off from the exterior of the container. And, tank liquid during the tank refill mode must enter the container which is open in the same direction as the rising water level so that measures must be taken to ensure an adequate refilling of the container with tank liquid before it is sealed off.

SUMMARY OF THE INVENTION

It is an object of the present invention to provide a liquid dispenser, for the flush tank of a toilet, which is simple and economical in its construction, efficient in its operation, easy to manufacture and makes use of a one-piece closure for effectively discharging a chemical concentrate in varying amounts, when desired.

Another object is to provide such a dispenser which permits only a limited amount of tank liquid to be admitted to the interior of the container after which a flow passage is closed so as to prevent migration of the chemical from the container into the tank during the dwell time between flushes to thereby avoid a needless wasting of the chemical by overtreating the tank liquid.

A further object of this invention is to provide such a dispenser which features a positively controlled piston-displacement discharge of chemical concentrate from the interior of a container into the outflowing tank water only at the end of the flush cycle, thereby providing a greater concentration of chemical in the toilet bowl as the result of this delay.

A still further object of the present invention is to provide such a dispenser comprising an open container having a quantity of concentrated soluble material therein capable of being dispensed as a liquid concentrate upon the downward stroke of a piston extending into the container and being responsive to the falling level of liquid in the tank. The piston is part of a closure having an annular wall surrounding the container and forming, together with the piston, a flow passage for the liquid between the interior and exterior of the tank. The length of the piston stroke is controlled by the provision of cooperating stops on the container and the closure, and the piston has an upwardly open cavity for retaining a quantity of tank liquid when the receding level of the tank liquid passes below the upper rim of the closure. Entrapped air in the flow passage is retained within the closure during the tank refill cycle causing the closure to be buoyed upwardly to its limit stop during the tank refill cycle. And, the length of the piston stroke may be varied by the use of limit stops spaced at different intervals along the container for selective cooperation with a limit stop on the closure upon relative rotation. Alternatively, an air cushion provided in lieu of the piston effectively functions as a piston in forcing the chemical concentrate outwardly of the container.

A still further object of this invention is to provide such a dispenser as having openings between an upper portion of the cavity and the flow passage for purging liquid chemical concentrate therefrom during the flush cycle.

Other objects, advantages and novel features of the invention will become more apparent from the following detailed description of the invention when taken in conjunction with the accompanying drawings.

DETAILED DESCRIPTION OF THE INVENTION

Figure 1:
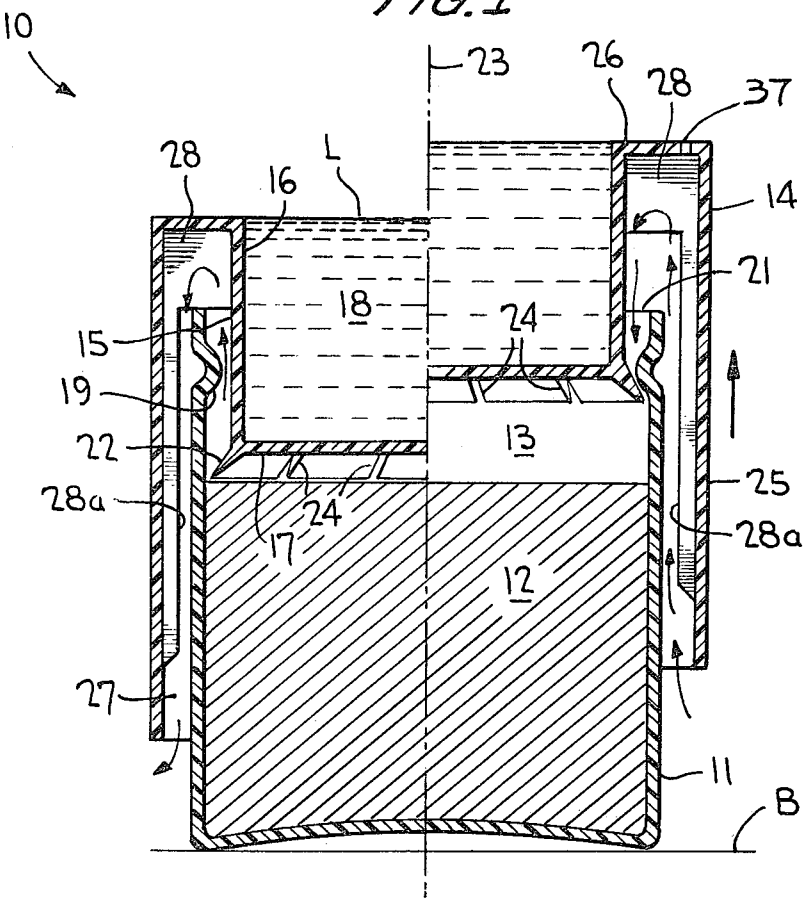
FIG. 1 is a vertical sectional view of one embodiment of the dispenser according to the invention, showing the closure at the limit of both its downward and upward positions in a combined view.

Turning now to the drawings wherein like reference characters refer to like and corresponding parts throughout the several views, a toilet chemical dispenser according to one embodiment of the invention is generally designated 10 in FIG. 1 and comprises a container 11 which may be of generally circular cross-section having a top opening and being formed of a material of a specific gravity sufficiently greater than 1.0 to ensure that the container remains positioned on bottom B of a flush tank (not otherwise shown) during the flush/fill cycle of the tank until a quantity of solid chemical material 12 located within the container is completely dissolved and the chemical concentrate is depleted to essential exhaustion. Chemical 12 may be in the form of a solid cake for disinfecting, deodorizing and cleaning the associated toilet bowl (not shown) as the cake dissolves into the liquid with which it is in contact until the volume in a space 13, above the solid chemical and beneath the piston, is sufficiently concentrated that a saturated solution exists within the dispenser.

The dispenser further comprises a one-piece dispenser closure 14 which is actuated by the action of the rising and falling of the water in the flush tank which is being treated. The closure may be of a non-metallic material, such as a plastic, and comprises a piston 15 defined by an annular wall 16 closed at its bottom by a wall 17. The piston itself thus forms an upwardly open cavity 18 for the retention of tank liquid when the level thereof moves below the top of the closure during the tank flushing cycle, as will be more fully discussed hereinafter.

The container is formed with an annular bead 19 near an upper edge 21 thereof, the bead extending inwardly of the container and being formed by an upsetting of the container wall or in any other suitable manner. An outwardly extending annular lip 22 is provided on the piston for engagement with bead 19 so as to limit the upward stroke of the piston as shown to the right of centerline 23 in FIG. 1. Lip 22 is interrupted along its length by a plurality of spaced radially extending slits 24. Therefore, engagement between lip 22 and bead 19 does not form a liquid seal between the interior and exterior of the container.

The closure further has an annular depending wall 25 surrounding the container, walls 16 and 25 being interconnected by a top annular wall 26. And, walls 16 and 25 are respectively spaced from the interior and exterior of the container so as to define a liquid flow passage 27 between opposite sides of the container. Furthermore, stops such as radially extending and circumferentially spaced ribs 28 or the like extend between walls 16 and 25. These ribs also form baffles defining cells or pockets therebetween for retaining trapped air in the closure whenever submerged, including movement in either direction. And, ribs 28 overlie upper edge 21 of the container so as to bear thereagainst to limit the downward movement of the closure relative to the container as shown to the left of centerline 23 in FIGS. 1 and 2. Long and slender portions **28*a* of these ribs extend along wall 25 and are slightly spaced from container 11 so as to define guide ribs for the closure which will permit a greater annular liquid flow passage but nevertheless maintain axial stability of the closure against cocking during movement between its upper and lower limits. And, in lieu of ribs 28, lugs or a shoulder at the base of the container, underlying the lower edge of wall 25**, could be provided for functioning in a like manner.

In operation, when dispenser 10 is placed in a toilet flush tank so as to rest on bottom B thereof, a quantity of tank liquid L fills cavity 18 and likewise enters (depicted by the arrows shown to the right in FIG. 1) the interior of the container through passageway 27 so as to fill space 13. As the liquid level in the tank rises above the lower edge of wall 25, air becomes entrapped beneath the closure to thereby produce a flotation effect rendering closure 14 buoyant. The air volume within the dispenser is compressed within the pockets (formed by ribs 28) by the rising liquid level in the tank to the extent of the head of liquid above the dispenser. Closure 14 therefore rises to its upper limit as shown to the right in FIG. 1. During the tank flush cycle, the liquid level falls and, when it exposes the top portion of the dispenser, the reduced buoyancy of the entrapped air in the pockets coupled with the added weight of the liquid held in the piston cavity, causes the dispenser to be depressed downwardly. The piston thus enters the container displacing the liquid chemical concentrate thereunder, and causing it to overflow edge 21 of the container through passageway 27 and into the tank liquid. The downward movement of the closure is limited by the lower edges of ribs 28 which, as mentioned above, retain spaces thereby serving as entrapped air pockets to assist in the closure rising movement. Since the chemical concentrate is expelled near the end of the flush mode, the concentrate is largely retained in the toilet bowl after the flush.

During the tank refilling cycle, the tank liquid level rises and enters passageway 27 so as to flow, in the direction of the arrows shown to the right in FIG. 1, into space 13 within the container since the passageway is fully open as the liquid rises to the level of top wall 26. When it reaches this level, the air pockets formed between ribs 28 during the liquid flow through the passageway buoys the closure upwardly causing the closure to rise with the rising liquid until it reaches its upper limit as shown to the right in FIG. 1. As the closure rises, the upward withdrawal of the piston from cavity 13 is in the suction or intake mode so as to draw tank liquid into space 13 as with the suction stroke of a pump, and is augmented by the head of water above the dispenser. In this condition, lip 22 is in engagement with bead 19 although, as mentioned above, no seal is effected by reason of such engagement since liquid is permitted to flow through slots 24. Nevertheless, a separation between the interior and exterior of the container is effected by the aforedescribed air pockets which thereby prevent the migration of chemical concentrate into the tank between flushes since cavity 13 is a dead space. Thus, direct communication between the liquid concentrate within the dispenser and the liquid in the tank is interrupted.

Figure 2:
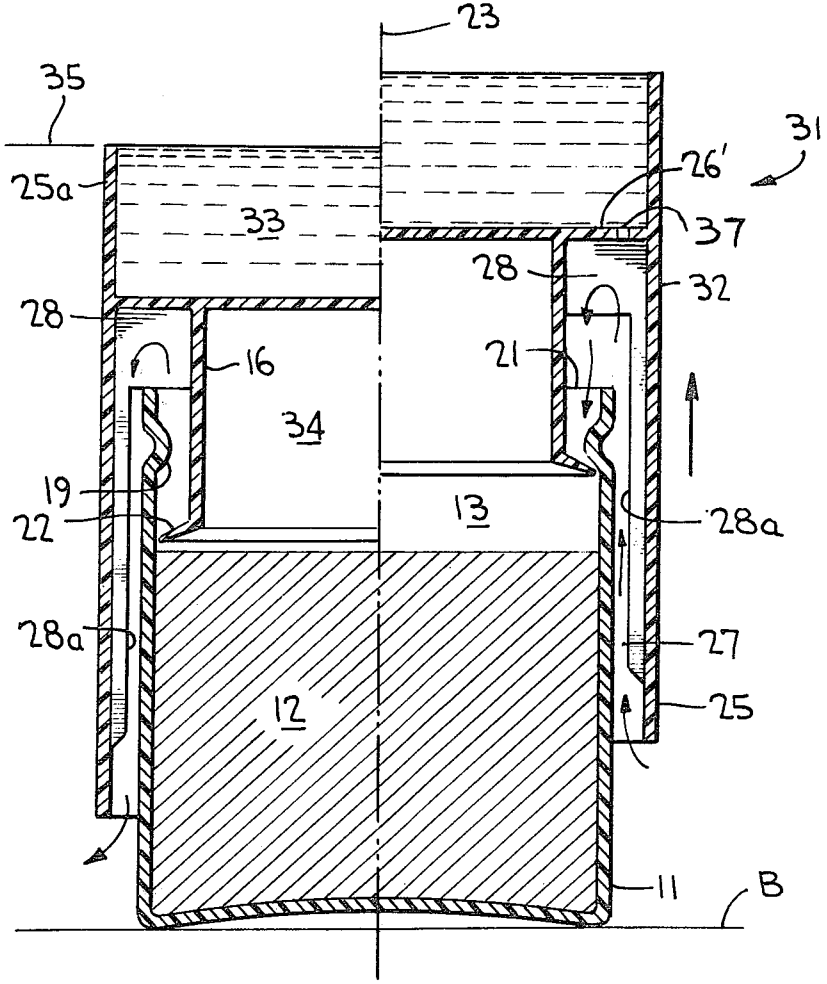
FIG. 2 is a vertical sectional view of another embodiment according to the invention, showing the closure at the limit of both its lowered and raised positions in a combined view.

A dispenser generally designated 31 in FIG. 2, is the same as dispenser 10 in its operation but is slightly different in its construction. Like elements will therefore be identified by like reference numerals. A closure 32 of this dispenser is similar to closure 14 in that it has concentric annular walls 16 and 25 depending from an upper wall 26' and respectively spaced from the interior and exterior of the container so as to form a passageway 27. However, bottom wall 17 forming part of the piston of closure 14 is eliminated from closure 32 and the top of annular wall 16 is closed by wall 26' which interconnects walls 16 and 25. And, wall 25 is extended upwardly, as at 25*a*, from wall 26' so as to form, together with wall 26', a cavity 33 which functions similarly to that of cavity 18 for the retention of tank liquid during the tank flush mode.

With such construction, walls 16 and 26' define a downwardly open cup or space 34 for entrapped air which is similarly formed in the pockets defined between ribs 28 during elevation of the closure.

Another slight difference between dispensers 10 and 31 is that slots 24 may be eliminated in lip 22, and the undersurface of bead 19 may be formed as a valve seat, so that a seal is effected between engaging elements 19 and 22 (as shown to the right of centerline 23 in FIG. 2) for further separating the liquid within the dispenser from the liquid without, thereby eliminating the migration of concentrate into the tank between flushes.

Figure 4:
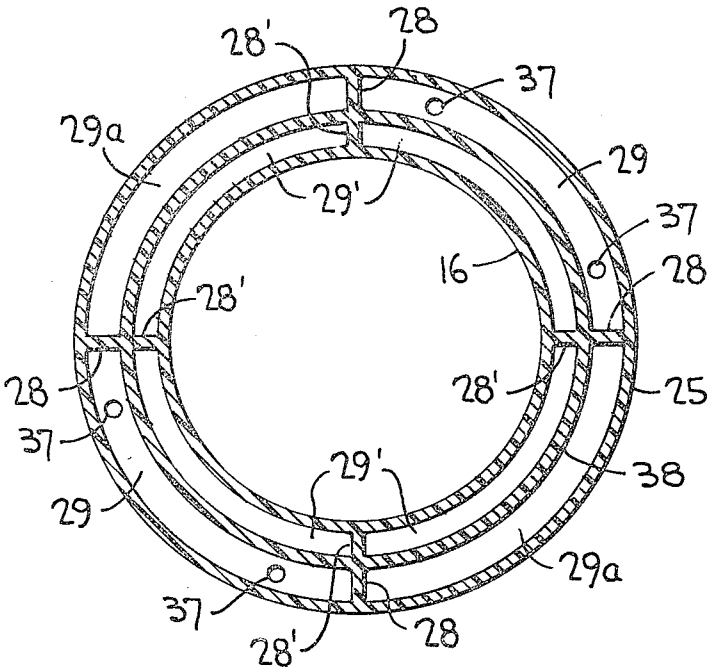
FIG. 4 is a sectional view taken substantially along line 4—4 of FIGS. 3 and 5.

The operation of dispenser 31 is similar to that of dispenser 10 in that, when the level of the tank liquid reaches the top of the dispenser at a level 35, during the tank refilling operation, liquid will have entered space 13 between cavity or cup 34 and the top of the chemical material in the container via passageway 27, so that the entrapped air within pockets 29 (defined between ribs 28, as seen in FIG. 4) and within cup 34 functions to elevate the dispenser closure as the flotation lift force exceeds the restraining force of the closure. An air pocket is maintained within space 34 during the tank refilling operation on the same principle that maintains an air pocket 29 in the spaces between ribs 28. Closure 32 thereafter rises with the continued rise of the level of the tank liquid as it blends with the tank liquid retained within cavity 33.

During the tank flush mode, the solid chemical material which dissolves into a liquid concentrate when the water in space 13 is expelled through passageway 27, in the direction of arrows shown to the left in FIG. 2, as the air cushion in space 34 forces the concentrated liquid chemical over upper edge 21 of the container while the dispenser closure is depressed downwardly. Such occurs when the falling tank liquid level reaches the top of closure 32 whereupon the reduce buoyancy of the entrapped air in the cells between ribs 28 and in cavity 34, together with the added weight of the liquid maintained in cavity 33, causes the closure to move downwardly together with the level of the tank liquid. The liquid concentrate is expelled by the moving air pocket in space 34 until stops 28 bear against upper edge 21 of the container. During this short downward stroke, the liquid concentrate is mixed with the receding tank liquid as it proceeds through the tank drain and into the toilet bowl.

It should be noted that the height of the water reservoir in the top of the dispenser effects the timing of the movement of the dispenser in both directions. That is, the weight of water within cavity 18 or cavity 33 is effectively weightless when submerged. However, as the level of the tank water recedes, it becomes progressively more forceful at the same rate as the recessive rate of the tank level. Thus, if the top of the water reservoir is higher above the tank bottom, then the downward force of the water weight begins sooner in the flush cycle. Conversely, if the height of the top of the cavity is lowered toward the tank bottom, then the effect of the weight of trapped water in this cavity is delayed with respect to the closing of the tank valve. The weight of water trapped in cavity 18 or cavity 33 may be increased by enlarging the diameter of the water reservoir.

Figure 3:
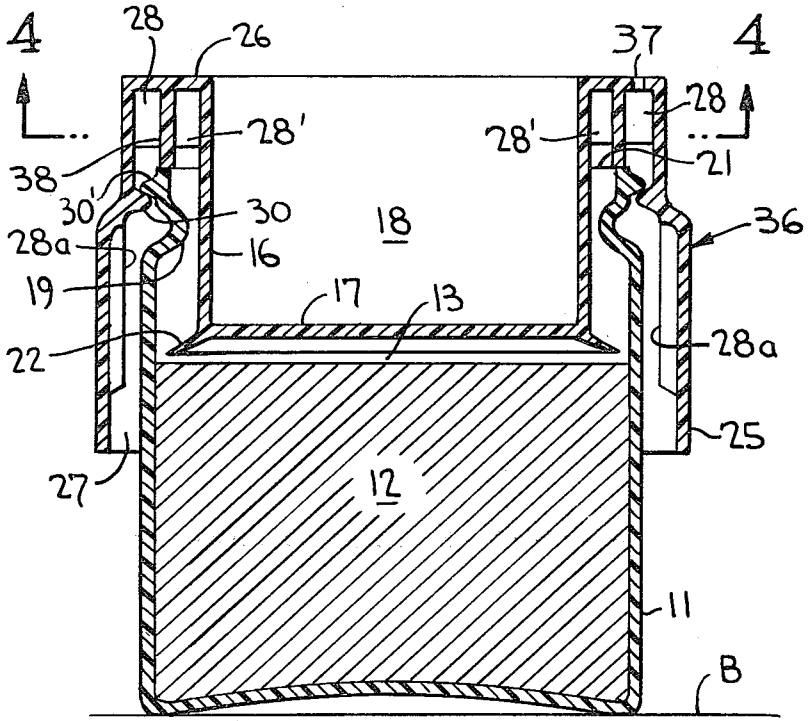

Dispenser 36 shown in FIG. 3, with its closure in a locked down position upon the interengagement of threads 30 and 30' operates the same as dispenser 10 but differs slightly in its construction. Like elements will therefore be identified by like reference numerals. In the FIG. 3 embodiment, ribs 28 are radially disposed on the inner surface of wall 25 (see FIG. 4) similarly as in FIG. 1 except that they do not define downward limit stops. An annular wall 38 extends downwardly from wall 26 and is spaced from both walls 25 and 16. Ribs 28 extend between walls 38 and 25, and ribs 28' extend between walls 16 and 38. Wall 38 overlies upper edge 21 of the container and provides a seal in the locked-down position of FIG. 3. Ribs 28*a* are located on the inner surface of wall 25 and permit enlarging the annular space defining flow passage 27 while preventing any cocking of the dispenser during its upward and downward movement. Wall 38 defines air pockets 29 and 29' together with ribs 28 and 28', for the same purpose as discussed in FIG. 1. The bottom edge of annular wall 38 comes to rest against upper edge 21 of the container in the locked-down closure position but remains spaced above edge 21 at the lower limit position of the closure as when thread 30 abuts against the upper side of thread 30'. Lip 22 engages rib 19 for limiting the upward stroke of the piston.

If the dispenser is not maintained vertical while being initially installed into the tank, the air within the dispenser cannot shift entirely to the high side thereof. Uneven buoyancy would thereby occur. Ribs 28 and 28' thus form baffles for trapping the air in annular cells or pockets 29*a* and 29' which are shown in FIG. 4 including ports 37.

Figure 5:
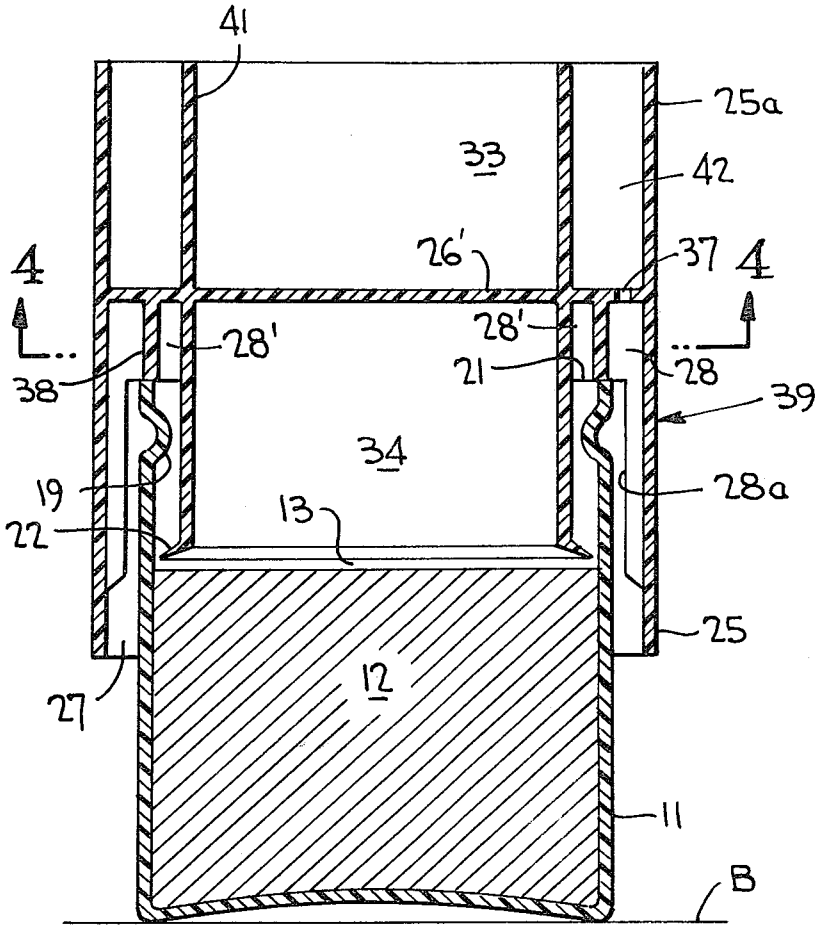
FIGS. 3 and 5 are vertical sectional views of further embodiments of the invention with their closures shown at their lower limit positions.

The FIG. 5 embodiment of a dispenser 39 is similar to that of dispenser 31 in FIG. 2 except that annular wall 38 extends downwardly from top wall 26', and bores or ports 37 are located in wall 26' between walls 38 and 25. Also, an annular wall 41 extends upwardly from wall 26' and defines with wall portion 25*a* an annular cavity 42. Thus, the tank water from this cavity 42 will purge the concentrate from annular space 27 into the tank through bores 37 without retaining any residual concentrate therein to be dissipated into the tank liquid on the tank fill cycle where dispenser wall 25 remains beneath the level of liquid in the tank at the lowest level.

For each of the disclosed embodiments, at least one port 37 is located in the closure member for venting passage 27 as well as to facilitate the flushing of concentrate from the passage into the tank during the tank flushing mode. The dispenser is initially primed and its closure is permitted to rise each time with the rising tank liquid during the tank refill mode. And, as the level of tank liquid falls below top wall 26 of the closure, liquid flowing through port 37 flushes the concentrate from passage 27 into the tank.

Ports 37 are sized so as to control the flow rate of the water therethrough, and may be designed to effect a lag in flow behind that of the rate of fall of the tank liquid level so as to provide added thrust against the air cushion in space 34, during the receding phase of the cycle. However, there is no net effect of this added volume on the tank refill cycle since the tank fill rate is sufficiently slow that passage of tank water upwardly through flow passage 27 is essentially unimpeded. It can be seen that even if the fill cycle were impeded, there would be no serious or deleterious effect unless and until the fill rate of the tank caused an inordinarily high flotation effect, lifting the assembly off of the bottom of the tank. The relative sizes of passage 27, air pockets 29*a*, 29′, spaces 29 and drain holes 37 permit considerable design options in achieving specific discharge modes and recharge cycles.

Ports 37 may thus be located in alternate cells such as 29 for providing additional air cells 29*a*. However, ports 37 may likewise be provided in cells 29*a* of the FIG. 5 embodiment since a large air-filled cavity 34 is included in this dispenser.

Figures 6, 8, 9:
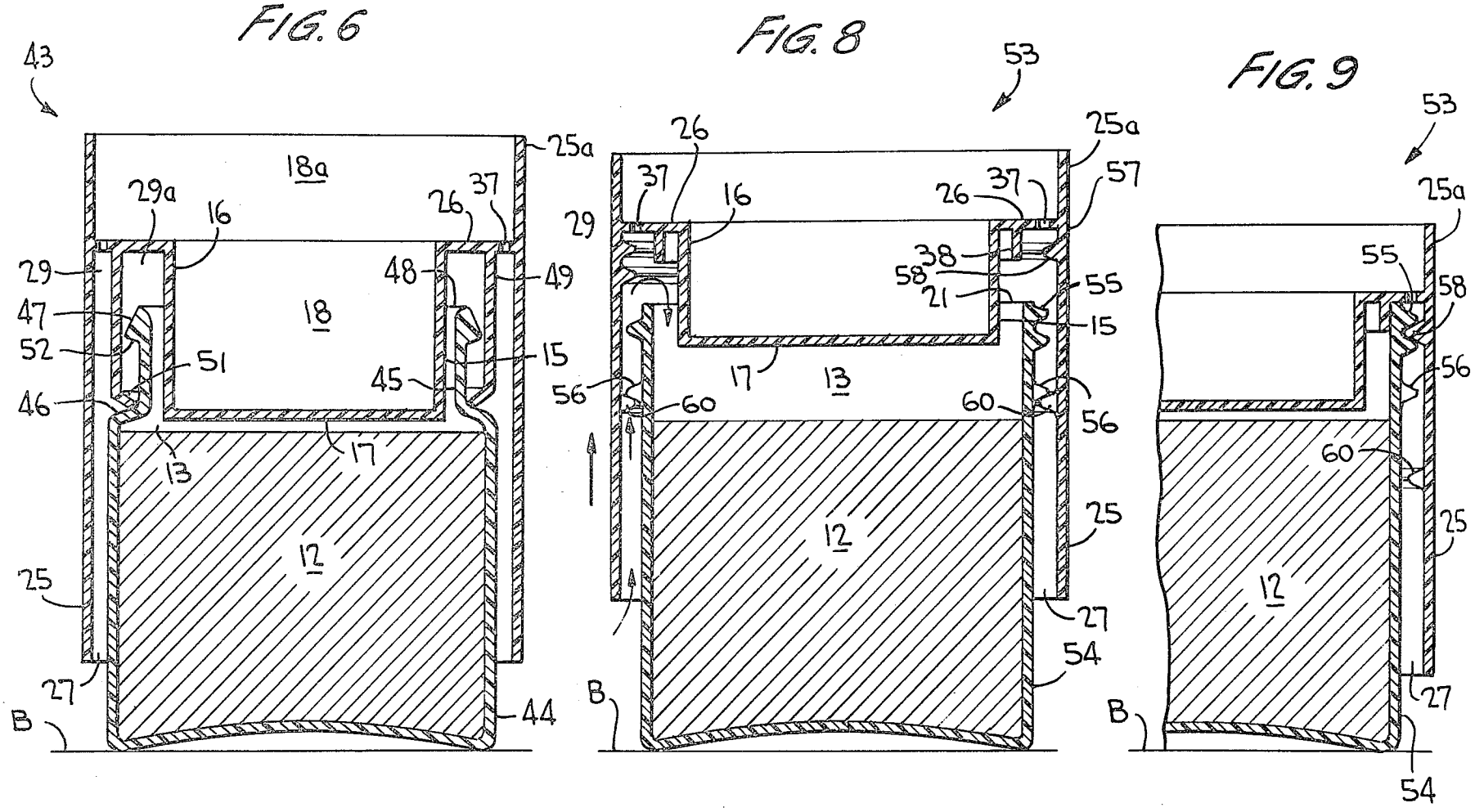
FIG. 6 is a vertical sectional view of yet another embodiment of the dispenser according to the invention, showing the closure at its lower limit.
FIG. 9 is a vertical sectional view of part of the FIG. 7 dispenser showing the closure locked onto the container.
Figure 12:
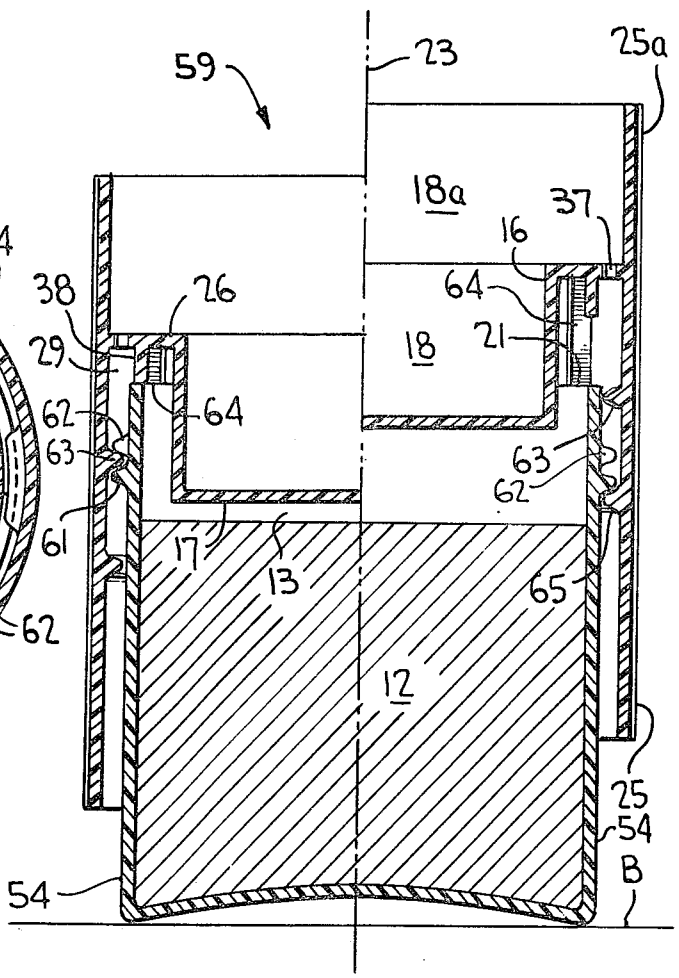
FIG. 12 is a view similar to FIG. 10 of the same embodiment of the dispenser shown therein except that both the closure and the container are shown in vertical cross-section.

In the FIG. 6 embodiment, a dispenser 43 functions the same as dispenser 10 but is of slightly different construction. Dispenser 43 includes a container 44 which is similar to container 11 except that it has a neck portion 45 defining a shoulder 46, and an outwardly extending annular bead 47 provided on the neck portion adjacent an upper edge 48 thereof. Wall 16 of piston 15 and wall 25 depend from top wall 26 and are respectively spaced inwardly and outwardly of the container so as to define passageway 27. A skirt 49 likewise depends from wall 26 slightly outwardly of bead 47, and has an annular inwardly extending lip 51 at the lower end thereof. This lip engages shoulder 46 so as to define a limit stop for the closure during its downward movement. Conversely, bead 47 forms an upper limit stop for the closure as lip 51 engages the bead. A valve seat 52 is formed along the undersurface of the bead so that, when the lip is engaged therewith, a liquid seal is formed between the interior and exterior of the container so as so assist in preventing migration and mixing of the liquid in the tank between flushes with the liquid chemical concentrate in chambers 13 beneath piston 15. Otherwise, the air pockets formed in spaces 29 and 29*a* will form an effective separation between the interior and exterior of the container similarly as described with reference to FIG. 1.

A one-piece dispensing closure is thereby formed which is actuated by the action of the rising and falling of the liquid in the tank for ingesting tank water within the container during the upward stroke of the piston and for together expelling liquid chemical concentrate from the container into flow passage 27 and into the tank as required, similarly as described for the operation of liquid dispenser 10. Upper and lower limit stops for the closure are respectively defined by bead 47 and shoulder 46 when engaged by lip 51. This lip is spaced from wall 26 a distance greater than the spacing of shoulder 46 from upper edge 48 so as to maintain spaces 29 and 29*a* at the downward limit of the closure. Air pockets in these spaces are therefore assured of forming during the rising action of the closure.

Wall 25 extends upwardly as at 25*a* so as to define an upper cavity or reservoir 18*a* in open communication with cavity 18. Ports 37 are located in upper wall 26 between walls 25 and 49 so as to permit water from cavity 18*a* to purge the concentrate from passage 27 during the flush cycle, as in a manner described with reference to the earlier embodiments.

Figure 7:
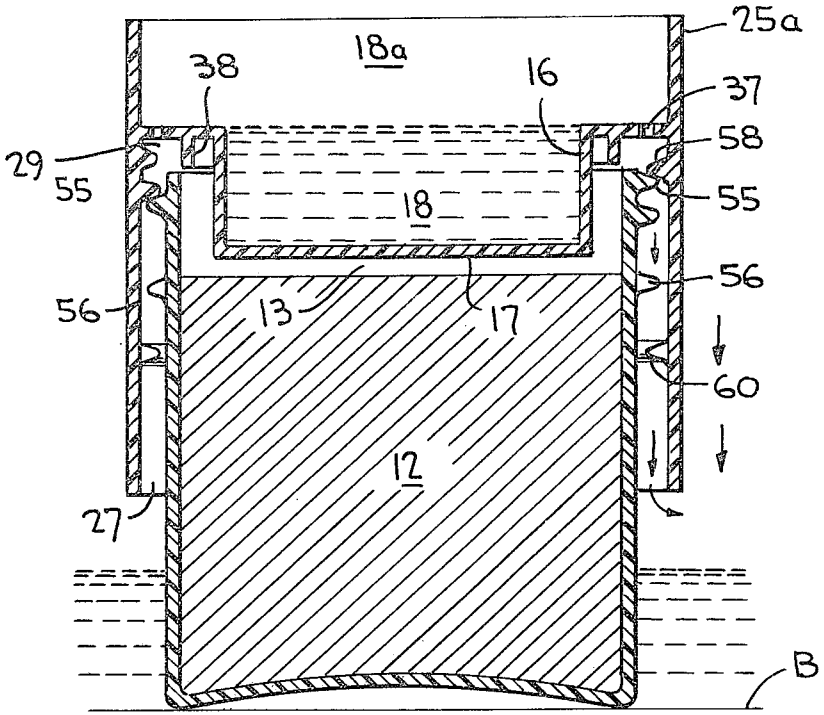
FIGS. 7 and 8 are vertical sectional views of still another embodiment of the invention respectively illustrating the closure at the limit of its lowered and raised positions.

A liquid dispenser 53, shown in FIGS. 7, 8 and 9, is similar to dispenser 10 except that a container 54 is provided and has an upper thread 55 and a lower bead 56 respectively forming lower and upper limit stops for closure 57. Piston 15, defined by walls 16 and 17, depends from upper wall 26 into the interior of the container through upper edge 21 to function similarly as in FIGS. 1 and 6. Passageway 27 is formed between container 54 and walls 25, 16 spaced therefrom, and space 29 forming an air pocket is located beneath top wall 26 and above the upper edge of the container.

A bead 60 is formed on wall 25 for engagement with bead 56 to limit the upward movement of the closure as in FIG. 8, and a thread 58 is formed on wall 25 for engagement with thread 55 to limit the downward movement of the closure as in FIG. 7. Threads 55 and 58 are so positioned as to maintain space 29 at the downward limit of the closure so as to permit an air pocket to be formed therein during the liquid rising and closure rising action as in a manner described with reference to FIG. 1. Besides forming lower limit stops, threads 55, 58 permit closure 57 to be locked in place on container 54 (FIG. 9) upon relative rotation thereof. The contents of dispenser 53 are thus sealed within the container while storing or otherwise handling the dispenser when not in use.

And, beads 56 and 60 may be continuous so that the lower surface of bead 55 forms a valve seat. Thus, during engagement between the beads as in FIG. 8, any migration and mixing of the liquid chemical concentrate in space 13, with that of the liquid in the tank between flushes, is substantially avoided.

Wall 25 is extended upwardly as at 25*a* to form an upper cavity or reservoir 18*a* in open communication with cavity 18. An annular wall 38 extends downwardly from wall 26 and provides a flow channel for tank water drained from reservoir 18*a* in a manner to permit mixing with the effluent from within the container as the closure descends, thereby expelling concentrate outwardly beneath wall 25. The tank water from cavity 18*a* therefore purges the concentrate from flow passage 27, via ports 37, into the tank without retaining any residual concentrate therein to be dissipated into the tank liquid on the tank fill cycle when wall 25 remains beneath the surface of the tank liquid at its lowest level.

Figure 11:
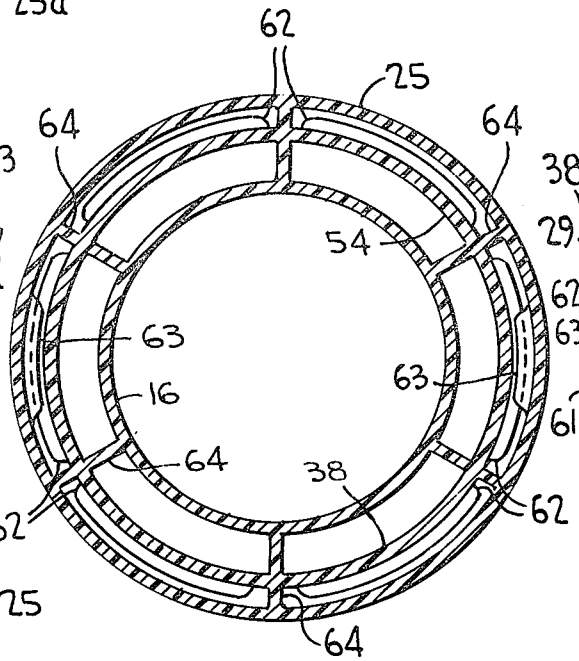
FIG. 11 is a sectional view taken substantially along line 11—11 of FIG. 10.
Figure 10A:
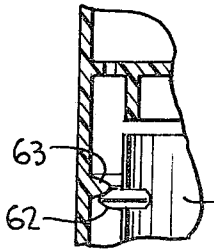
FIG. 10A shows a part of the FIG. 10 dispenser with the closure at its lower limit positions.
Figure 10:
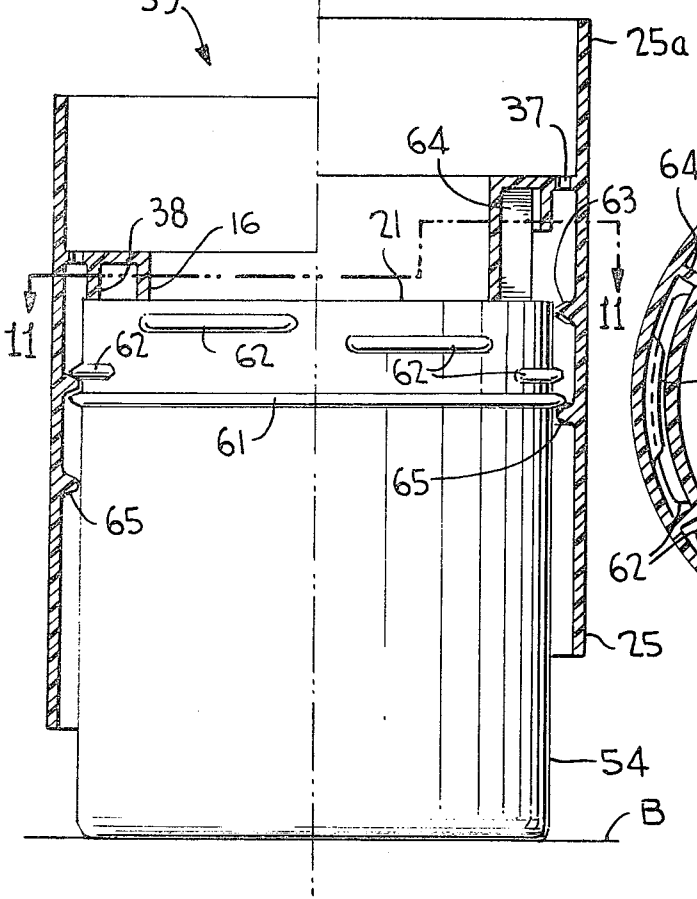
FIG. 10 illustrates still another embodiment of a dispenser according to the invention, showing the container in side elevation and the closure in vertical section both at the limit of its lowered and raised positions in a combined view.

A liquid dispenser 59, shown in FIGS. 10, 10A, 11 and 12, is similar to dispenser 53 except that provision is made for adjusting the amount of liquid chemical discharged by varying the downward stroke of the closure. An uninterrupted annular bead 61 is provided on container 54, and beads 62, each of a predetermined short length, likewise are provided on the container. Opposing pairs of beads 62 are spaced different distances from upper edge 21, and adjacent beads 62 are slightly spaced apart as shown in FIG. 11. An opposing pair of beads 63 are formed on wall 25 of the closure and extend toward the container for engagement with a selected pair of beads 62 upon rotation of the closure relative to the container into alignment therewith. As seen in FIG. 11, the length of beads 63 are slightly less than that of the cooperating pair of beads 62 so as to interfere with adjacent beads 62. FIG. 10A shows engagement between aligned beads 62 and 63 in a lowermost limit position of the closure. And, FIG. 10, to the left, shows a locked-down position of the closure as beads 63 are made to engage beneath aligned beads 62.

Vertical lugs 64 are provided on wall 25 of the closure and project inwardly between the spaced beads 62 to thereby provide an index adjustment and to prevent random rotational movement of the closure, thus maintaining the desired setting of the closure relative to the container. And, an annular uninterrupted bead 65 is provided on wall 25 and extends toward the container for engaging the undersurface of bead 61 to limit the upward movement of the closure and shown to the right in FIG. 10. The undersurface of bead 61 forms a valve seat so that, during engagement between beads 61 and 65, the interior of the container will be sealed from the exterior thereof.

The downward stroke of the closure and its piston may thus be changed to adjust the concentration of the treatment by varying the amount of liquid chemical concentration during each cycle. The closure may be rotated relative to the container until lugs 63 are placed in alignment with a selected opposing pair of lugs 62. Lugs 64, which project into the spaces between adjacent beads 62, maintain such a rotated position of the closure. FIG. 10A illustrates engagement of lugs 63 and 62 to effect the longest possible downward stroke of the piston. Obviously, the shortest possible downward stroke of the piston will be defined upon rotation of the closure until lugs 63 are placed in alignment with that pair of lugs 62 lying nearest upper edge 21. Lugs 62 therefore form downward limit stops with the piston, and bead 61 forms an upper limit stop.

From the foregoing it can be seen that a simple and economical yet highly effective liquid dispenser is provided for positively controlling the discharge of liquid chemical concentrate from the interior of a container into the outflowing tank liquid only at the end of the tank flush cycle, thereby providing a greater concentration of chemical for performing the desired functions of cleaning, disinfecting and deodorizing. The dispenser makes use of a one-piece closure which is actuated by the action of the rising and falling of the tank liquid, and allows only a fixed amount of tank liquid to be admitted to the interior of the container after which a flow passage is closed off so as to prevent migration of the concentration from the container into the tank during the dwell time between flushes, thereby avoiding a needless waste of chemical by over-treating the tank liquid.

The chemical concentrate in the container may be in solid form or in liquid concentrated form, and the closures of each of the embodiments may be locked in place over their containers by any conventional means such as by cooperating screw threads. Thus, the contents of the container may be enclosed against exposure to evaporated losses, moisture, absorption from humid environments, escaping odors while on shelves, etc. The dispenser may be likewise deactivated within the tank without the need to remove it from the tank. Several of the embodiments herein permit the amount of liquid chemical discharge to be adjusted from the container on each flush cycle, and a positive retention of the adjustment setting is conveniently provided. Waste by over-treatment of the tank liquid is prevented by the present invention by the inclusion of an automatic valving action at the end of the refilling mode which closes off the concentrate solution within the container from the liquid tank, thereby avoiding seepage into the tank. The dispenser effects a thrust of the chemical concentrate from the container into the tank by means of the piston having reciprocable biasing capabilities. The container may be refilled with chemical concentrate by simply inserting a fresh cake of solid chemical into the container, thus amounting to a recycling of the dispenser package. And, the dispensers are capable of ensuring that the tank water will purge the concentrate from the flow passage between the closure and the container during the tank emptying cycle.

Obviously, many other modifications and variations of the invention are made possible in the light of the above teachings. For example, the dispenser is not limited to the discharging of a liquid chemical solution into a flush tank, but may be utilized for the discharge of liquid into other environments, and for the discharge of other fluids such as water softeners, rust inhibitors, algoecides, and the like. And, wall 17 of the piston in each embodiment may be located at a position intermediate the upper and lower ends of wall 16 so that an upwardly open cavity 18 and a downwardly open cavity 34 are both within annular wall 16 and are separated by wall 17. It is therefore to be understood that within the scope of the appended claims, the invention may be practiced otherwise than as specifically described.

I claim:

1. A liquid dispenser for a flush tank, comprising, a container having a quantity of concentrated soluble material therein capable of being dispensed as a liquid concentrate, said container having a top opening, a dispensing closure having a piston depending through said top opening, said piston defining an upwardly open cavity to be filled with tank liquid and having a predetermined center of gravity, said closure being adapted to rise and fall with the fluid level in the tank respectively during tank refill and flushing operations, cooperating stop means on said closure and on said container for limiting the upward and downward strokes of said piston, said closure having a depending wall surrounding said container during both said upward and downward strokes of said piston, said piston and said wall being spaced from opposite sides of said container to define a flow passage between the interior and exterior of said container during both said upward and downward strokes, means defining a plurality of air pockets between upper portions of said piston and said wall, said air pockets defining a center of flotation lying upwardly of the center of gravity of the water—filled piston, at least one bore in said closure outwardly of said piston for venting said passage, whereby liquid may flow into said container through said vented passage for mixing with an amount of the material therein during said upward stroke, and the mixed material may be expelled from said container during said downward stroke as said piston forces the mixed material through said passage and as the mixed material is flushed out of said passage by the receding tank fluid flowing through said vent, and whereby a separation between the interior and exterior of said container is effected by said air pockets to thereby prevent any migration of the material into the tank between flushes.

2. The dispenser according to claim 1, wherein said means for limiting said upward stroke comprises an interrupted lip on said piston which functions solely as an upward limit stop, and a bead on said container.

3. The dispenser according to claim 1, wherein said means for limiting said downward stroke comprises ribs extending between said piston and said depending wall, said ribs comprising said air pocket means.

4. The dispenser according to claim 1, wherein said closure includes a side wall and a bottom wall defining said cavity.

5. The dispenser according to claim 1, wherein said side wall extends upwardly of said cavity for forming a reservoir in communication therewith , said reservoir to be filled with tank liquid and overlying the space between said depending wall and said container, said bore extending between said reservoir and said space.

6. The dispenser according to claim 1, wherein longitudinal ribs are provided on one of said container and said depending wall for substantially preventing any cocking movement of said closure relative to said container during the rise and fall thereof.

7. The dispenser according to claim 1 or 5, wherein said container has a neck defining a shoulder, a bead on said neck and a skirt on said closure having a lip, said lip cooperating with said shoulder for limiting said downward stroke, and said lip cooperating with said bead for limiting said upward stroke.

8. The dispenser according to claim 1, wherein said stop means comprise axially spaced beads.

9. The dispenser according to claim 8, wherein said beads define screw threads for locking said closure on said container.

* * * * *